US005706959A

United States Patent [19]

Smith

[11] Patent Number: 5,706,959

[45] Date of Patent: Jan. 13, 1998

[54] DISPLAY STRUCTURE WITH LOCK-IN TRAYS

[75] Inventor: Michael J. Smith, Orangeburg, N.Y.

[73] Assignee: Arrow Art Finishers, Inc., Bronx, N.Y.

[21] Appl. No.: 720,787

[22] Filed: Oct. 3, 1996

[51] Int. Cl.[6] ..... A47F 5/00

[52] U.S. Cl. ..... 211/132; 211/126.16; 211/149; 248/174; 108/165

[58] Field of Search ..... 211/132.1, 149, 211/126.16, 126.6, 135; 248/174; 108/165

[56] References Cited

U.S. PATENT DOCUMENTS

| | | | |
|---|---|---|---|
| 4,506,790 | 3/1985 | Muscari | 248/174 X |
| 4,519,319 | 5/1985 | Howlett | 248/174 X |
| 5,042,651 | 8/1991 | Davis et al. | 211/132.1 |
| 5,141,105 | 8/1992 | Maye | 211/135 |
| 5,145,244 | 9/1992 | Kersting et al. | 211/149 X |
| 5,213,220 | 5/1993 | McBride | 211/126.16 X |
| 5,315,936 | 5/1994 | Smith | 211/149 X |
| 5,316,156 | 5/1994 | Land et al. | 211/132.1 X |
| 5,322,172 | 6/1994 | Maglione | 211/126.16 X |
| 5,443,168 | 8/1995 | Dyment et al. | 248/174 X |
| 5,564,578 | 10/1996 | Smith | 248/174 X |

*Primary Examiner*—Robert W. Gibson, Jr.
*Attorney, Agent, or Firm*—Kirschstein et al.

[57] ABSTRACT

A display arrangement includes a support structure including a rear wall, and a pair of side walls jutting out of the rear wall substantially perpendicularly thereto and connected to it in a manner maintaining them in their respective positions relative to one another so that such walls together bound a confining space. At least one pair of supporting formations is integrally formed out of the side and rear walls, each of such formations including two segments one extending substantially perpendicularly to the rear wall and the other extending along one of the side and rear walls to hold the one segment in position. At least one tray bounding a space for containing items to be displayed in the display arrangement is supported in the confining space of the support structure on the one segment of each of the supporting formations.

16 Claims, 4 Drawing Sheets

DISPLAY STRUCTURE WITH LOCK-IN TRAYS

BACKGROUND OF THE INVENTION

1. Field of the Invention

The present invention relates to display arrangements in general, and more particularly to a display structure of the type including a plurality of superimposed shelve-like formations equipped with respective barriers preventing items on display on the shelves from falling out of the structure.

2. Description of the Related Art

There are already known various constructions of display structures of the type here under consideration, among them such that are equipped with a plurality of shelves arranged at different elevations above the ground in the overall structure. In some instances, the shelves are slanted downwardly toward the open front region of the structure so as to afford a better view of the articles or items being displayed while supported on such shelves. However, even if they are not, it is, more often than not, good practice to provide retaining bars, ridges or similar barrier formations at the zones of the shelves located at such an open front region, if for no other reason, than in order to prevent the items on display from sliding off of the shelves either by themselves (e.g. due to vibrations to which the structure may be subjected) or when such items and/or the structure supporting them are ineptly or incautiously handled, touched or shifted by a passerby or another person present in or moving through the vicinity of such a structure.

On the other hand, it is also known to accommodate various items that are to be displayed in a retail store or a similar establishment in which items are to be displayed to the public not only for observation but also, primarily, for purchase of such items by the respective patrons or customers, in the original cartons or other containers in which they were originally delivered to the store. However, since such containers, which will be referred to herein as trays because usually parts of the complete cardboard boxes constituting such containers while the items accommodated in them are in transit, are cut off to offer a better view of the items to be displayed, are typically rather unsightly, having been made so because cost rather than appearance is the controlling factor in deciding on the design of and materials used for making such boxes or containers, and may have been made even more so by the battering they have been subjected to while being stored at various locations and transported from a respective preceding one to the next successive one, the use of such trays so far has been strictly limited to those displays in which the appearance of the tray is only of a minor significance, if any, for instance to confine in place respective bottles of beverages, liquid detergents or the like while being arranged in respective stacks in grocery supermarkets or the like.

While, at least in theory, it would be possible to put such trays, with the items already contained in them or placed in them afterwards, on respective support shelves, this practice has been pursued only rarely, if ever, and is so, then only when the trays were relatively small and decorative or at least not ugly in nature. One possible reason that this approach to displaying items in retail establishments has never gained any significant acceptance in the retail industry is that the mere placement of such trays on top of an underlying tier of items or even on various shelves, while reducing or even eliminating the risk of individual items falling to the ground from their location in or on the support structure, does not even address the equally likely possibility that the whole tray, with all the items in it, can be accidentally knocked off of the supporting shelf or similar support, or slide off of it due to ambient vibrations or the like.

Yet, there is an ever-growing and yet still unsatisfied need for the accommodation of a variety of items while on display in trays at least similar to those mentioned above and for the arrangement of such trays in or on more or less permanent structures or fixtures situated at predetermined locations of the retail establishment. This need or at least desire is there because the handling of the products or other items to be displayed is greatly facilitated by the confinement of such items in the aforementioned trays, especially when the trays are previously used as parts of the containers in which the items (which may themselves be containers, receptacles or packages for smaller items, or for flowable or even liquid substances) were accommodated between the time they were manufactured and the time they have reached their temporary destination at the retail establishment. On the other hand, the confining nature of the trays would greatly and desirably reduce the risk of individual items inadvertently leaving such trays and suffering damage as a result.

OBJECTS OF THE INVENTION

Accordingly, it is a general object of the present invention to avoid the disadvantages of the prior art.

More particularly, it is an object of the present invention to provide a display arrangement for or including at least one display tray, which arrangement does not possess the drawbacks of the known display arrangements of the aforementioned type.

Still another object of the present invention is to devise a display arrangement of the type here under consideration which is capable of holding the tray or each of a plurality of trays containing the items on display in its predetermined positions.

It is yet another object of the present invention to design the above display arrangement in such a manner as to not require, at least for the most part, any elaborate additional measures for providing respective support formations destined for supporting the respective tray on its supporting structure.

A still further object of the present invention is to develop a display arrangement of the above type the supporting structure of which can be easily folded into its final condition, with attendant movement of the supporting formations into their final positions as well.

A concomitant object of the present invention is so to construct the display arrangement of the above type as to be relatively simple in construction, inexpensive to manufacture, easy to use, and yet reliable in operation.

SUMMARY OF THE INVENTION

In keeping with the above objects and others which will become apparent hereafter, one feature of the present invention resides in a display arrangement which includes a support structure having a rear wall, a pair of side walls jutting out of the rear wall substantially perpendicularly thereto, and means for interconnecting the rear and side walls with one another in a manner maintaining them in their respective positions relative to one another so that they bound a confining space.

According to the present invention, the support structure further includes at least one pair of supporting formations integrally formed out of the side and rear walls and each including two segments one extending substantially perpendicularly to the rear wall and the other extending along one of the side and rear walls to hold the one segment in position. The support arrangement of the present invention further includes at least one tray bounding a space for containing items to be displayed in the display arrangement and supported in the confining space of the support structure on the one segment of each of the supporting formations. A particular advantage of the construction of the support arrangement as described so far is that the support formations, owing to their being constituted by integral parts of the side and rear walls, are already at the proper locations for their ultimate use, cannot be lost or misplaced and, moreover, are easily put to use by either being automatically, or with just slight prodding, deployed in the course of erection of the support structure.

According to another advantageous aspect of the present invention, the tray includes at least a bottom wall, a rear wall having an upper region as considered in an inserted position in which the tray is received in the confining space, and two side walls secured to the bottom and rear walls and holding them in positions relative to one another, and the support structure includes at least one finger arranged at but frontwardly spaced from its rear wall structure and confining the upper region of the tray between itself and the support structure rear wall in the inserted position of the tray. In this context, it is advantageous for the finger to be constituted by a portion of a holding element separate from the support structure but secured to it at its upper region. In this regard, it is particularly useful when the interconnecting means of the support structure includes at least a top wall connecting the rear and side walls with one another, and when the holding element is secured to the such wall.

However, it is even more advantageous when, in accordance with the present invention, the support arrangement further includes at least one additional pair of supporting formations similar to the one pair of supporting formations but situated at a higher elevation than the latter on the supporting structure as considered in an erected state of the latter. Under these circumstances, each of the supporting formations of the additional pair advantageously carries the aforementioned finger of its own for the confinement of that of the trays that is to be inserted into the confining space underneath the pair of supporting formations of the additional pair.

In accordance with an additional but still important facet of the present invention, the interconnecting means includes at least one reinforcing element secured to the side walls of the support structure at a predetermined elevation of the latter as considered in an erected state of the support structure and operative for preventing the side walls from moving apart at the elevation. This reinforcing element advantageously includes an elongated main portion extending across the space present between the side walls at an open front region of the support structure, and a pair of anchoring portions each rigidly connected with the main portion at a different end zone of the latter and extending along and anchored to a different one of the side walls of the support structure.

An especially advantageous construction of the display arrangement is obtained in accordance with the present invention when one of the segments of each of the support formations originally was an integral part of the side wall and the other a similarly integral part of the rear wall and are still connected to them and to one another by respective hinge portions but separated from them by an incision for the segments to be able to move out of the planes of such side and rear walls and into their desired positions in the support structure during the erection of the latter. In this context, and considering that the support structure includes main hinge portions each of which connects one of the side walls to the rear wall, it is particularly advantageous if not indispensable for that of the respective hinge portions which connects the one segment with the side wall to extend substantially normal to the respective associated one of the main hinge portions and for that of the respective hinge portions which connects the other segment with the rear wall to include an angle of substantially 45° with the aforementioned associated main hinge portion.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENT

Figure 1:
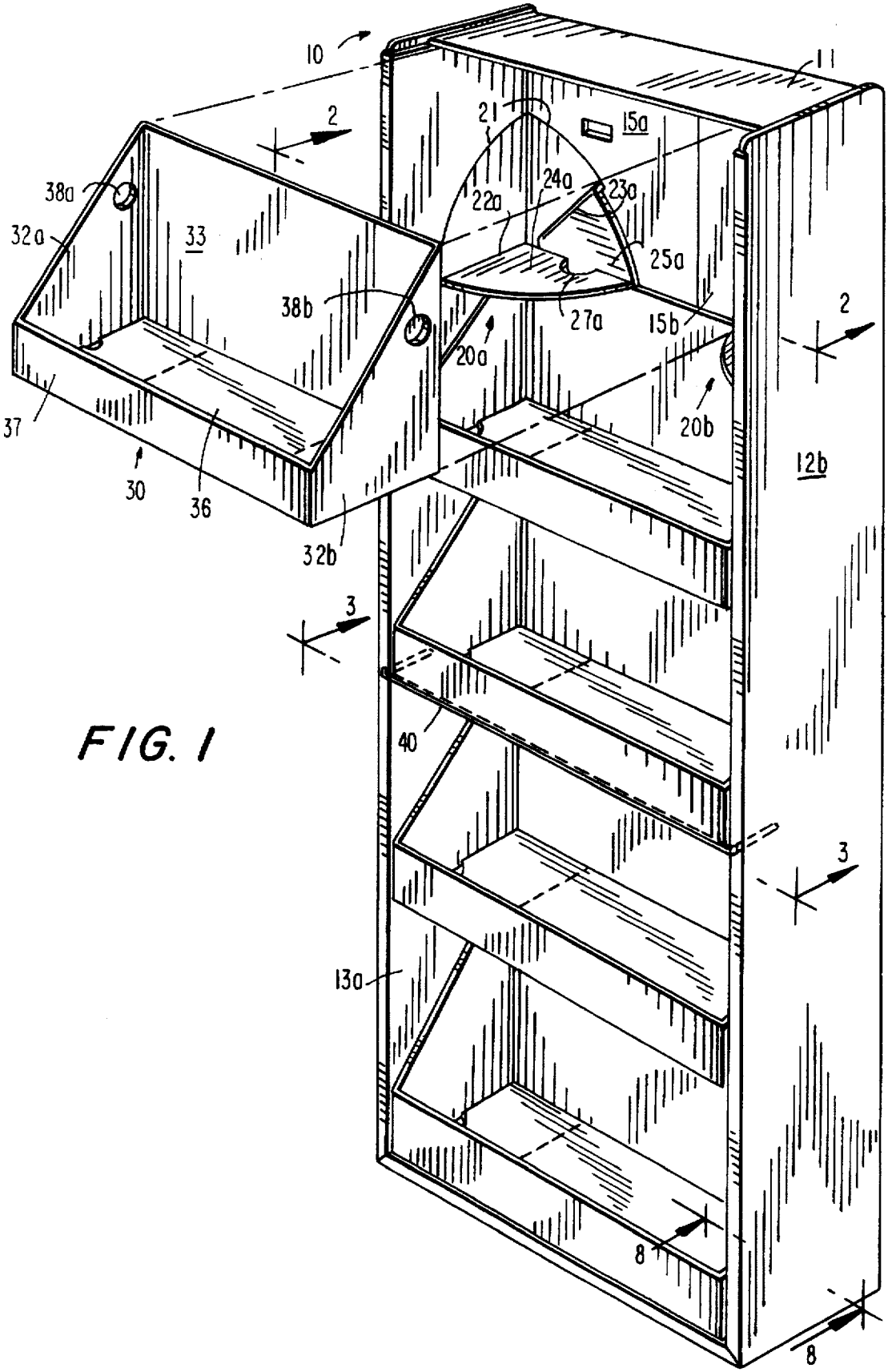
FIG. 1 is a perspective view of a support structure which, together with a plurality of display trays supported and held in their desired positions on the support structure, embodies the present invention

Referring now to the drawing in detail, and first to FIG. 1 thereof, it may be seen that the reference numeral 10 has been used therein to identify a supporting structure which is specifically designed for use in accordance or in conjunction with the present invention. The support structure 10 includes top and bottom walls 11 and 16, side walls **12*a* and 12*b*, and a rear wall 13. The structure 10 and any parts or portions associated with it is substantially symmetrical with respect to a central plane of symmetry extending substantially parallel to the side walls 12*a* and 12*b* substantially midway between them. Therefore, here and through the rest of this description and in the drawing, the suffixes a and b indicate that the respective part or portion is situated to the left or to the right of the central symmetry plane of the support structure 10** or another associated element, respectively; otherwise, there is no substantial difference between the parts or portions with different suffixes, so that any description of one will be equally applicable to the other and the reference numeral alone, without any suffix, will be occasionally used to identify either and each of them without differentiating between them.

It is also to be mentioned at this juncture that, for reasons that will become apparent as the present description proceeds, at least the side and rear walls 12*a*, 12*b* and 13 are doubled; in other words, there are provided additional side walls 14*a* and 14*b*, and an additional rear wall shown to consist of two rear wall sections 15*a* and 15*b*, with the additional side and rear walls 14 and wall sections 15 being situated inwardly of the associated walls 12 and 13 and being actually hinged to them in the case of the additional side walls 14 or to the latter in the case of the rear wall sections 15. This, of course, implies if not demands that the support structure 10 is or be made of as flexible material, such as corrugated board, cardboard or the like, and it will be assumed throughout this description that it, as well as any elements associated therewith, is or are, so made as currently contemplated. However, it should be understood that the principles explained here are equally applicable, possibly with minor and obvious modifications, to structures and associated elements of more permanent nature, such as those made of plywood or other materials of less flimsy nature than corrugated board, cardboard or similar materials, if it was ever decided, for some unfathomable reasons, to implement such principles using such sturdier materials.

The aforementioned inner walls and sections 14 and 15 not only serve as reinforcements for the walls 12 and 13 but another important, if not critical, purpose as well. More particularly, they constitute the stock from which respective support formations 20 (i.e. 20*a* and 20*b*) that will now be described in some detail are made. In other words, originally, each of the support formations 20 was a part and parcel of the associated side wall 14 and rear wall section 15 separated from both of them by an incision 21 but still connected to the respective associated ones of them by respective crease lines 22 and 23. However, in the process of erection of the support structure 10 into its form shown in the drawings, which consisted of folding the various portions of the latter about respective crease lines or similar weakened portions, which will from time to time also generally be referred to herein as hinge portions, respective segments 24 and 25 (those stemming from the walls 14 and 15, respectively and still connected to them by the hinge portions 22 and 23 and to one another by an auxiliary hinge portion 26) drop down either by themselves or in response to slight prompting by the personnel erecting the support structure 10 to constitute the respective one of the support formations 20 in its form as shown throughout the drawings.

It ought to be mentioned at this juncture that the hinge portion 22 extends substantially normal to, and the hinge portion 23 at an angle of substantially 45° with respect to, the otherwise unidentified hinge portion connecting the respective additional side wall 14 and rear wall portion 15 with one another. As a result, after the segments 24 and 25 have dropped down in the manner described above, the segment 24 extends substantially horizontally provided that the support structure 10 assumes its proper erected position, so that the upper surface of the segment 24 can thereafter be used as a support for a component to rest upon.

This component, in the illustrated case, is a tray-shaped element (referred to herein merely as a tray) 30 which, consistently with the support structure 10, includes respective side walls 32 (*a* and *b*), rear wall 33, front wall 37 and a bottom wall 36 that are joined to one another at respective corners. Here again, the tray 30 may be (and typically is) made of the same or similar material as the support structure 10, e.g. corrugated board, in which case the corner regions are constituted by respective crease lines or similar hinge portions around which the respective portions or walls 32, 33 and 37 have been turned relative to the bottom wall 36 in the process of formation of the tray 30 from its initially substantially flat precursor. For obvious reasons, the walls or portions 32, 33, 36 and 37 are permanently secured to one another in their illustrated positions relative to one another, but exactly how this is done and with what means is beyond the scope of the present invention; suffice it to say that methods similar to those prevalent in the packaging industry, such as gluing or stapling, can be used here as well.

It may also be observed in FIG. 1 that, rather than there being just one of the trays 30 (and an associated pair of support formations 20 for the tray to rest on), there is a number (five as shown) of such trays 30 (and a smaller by one number of such support formation pairs 20). It will be appreciated that the support formations 20 or the respective pairs are both situated at substantially the same elevation above ground or the bottom wall 16 (as considered in the aforementioned proper erected position) for the respective pair, but at different elevations for the different pairs of such formations 20. The vertical spacing between such different support formation pairs 20 (and between the lowermost of them and the bottom wall 16 substantially corresponds (i.e. equals or slightly exceeds) the maximum vertical dimension of the associated tray 30, that is the vertical dimension of its rear wall 33.

Also, the transverse dimension of the tray 30, that is the distance between the outer surfaces of the walls or portions 32, substantially corresponds (i.e. equals or is smaller, but only slightly, than) to the clear distance between the inwardly facing surfaces of the additional side walls 14 of the support structure 10. This means that the tray 30 can be introduced and substantially snugly received in the respective space provided for it between the respective vertically adjacent ones of the support formation pairs 20 (and/or the inner surfaces of the top or bottom walls 11 and 16) of the support structure, as shown in FIG. 1 for all but the topmost of the trays 30, as well as for the latter by respective phantom lines indicating the direction (but not necessarily the spatial orientation, as will be explained later) of insertion of such topmost tray 30 into the space provided for it in the support structure 10. It ought also to be mentioned at this juncture that the side walls 22*a* and 32*b* of the tray 30 are provided with respective apertures 38*a* and 38*b* that may be used as finger holes while the tray 30 (which may already be filled with the items to be displayed at that time) is being carried from one location to another and/or manipulated in the process of bringing it to the site of the support structure 10 and introducing it into the latter.

Now that the basic construction of the support structure 10 and of the trays 30 to be assembled with it has been explained, the time has come to divert attention to the remaining FIGS. of the drawing that show certain details of these and other elements together forming the finished display arrangement. However, before doing it, it ought to be pointed out that a basically half-moon shaped aperture 27*a* is provided, at the juncture of the segments 24*a* and 25*a* of the fully visible support formation 20*a* (here again, the same applies to the formation 20*b*, except that the latter is not fully visible in FIG. 1 of the drawing). A tab or finger 28 that was originally located in such an aperture 27 but has remained in the plane of the segment 25 as the segment 24 had moved out of the common plane with it. This purpose may probably best be perceived from FIG. 2 of the drawing where it is clearly visible that the respective finger 28 is located in front of the associated rear wall 33 of the tray 30; in other words, the rear wall 33 of the tray 30 is confined between the pair of the fingers 28 and the pair of the rear wall sections 15*a* and 15*b*. This confining action prevents the respective tray 30 from tipping or toppling over even when the items contained in the respective tray are rearranged in such a way that the bulk of them (and hence their cumulative center of gravity) is situated frontwardly of the support formations 20.

It will be realized that, since there is no pair of support formations 20 present at the top wall 11, neither are any fingers 28 stemming from it and, as a consequence, no such confining action would be available for the topmost one of the trays 30. This is remedied, in accordance with another aspect of the present invention, by securing additional interconnected members (identified as 20' including parts 24' and 28' (*a* or *b*) for the sake of consistency, but distinguished by the prim from their functional counterparts) to the top wall 11, with the finger 28' depending from the latter at a close proximity to the associated rear wall section 15.

Figure 2:
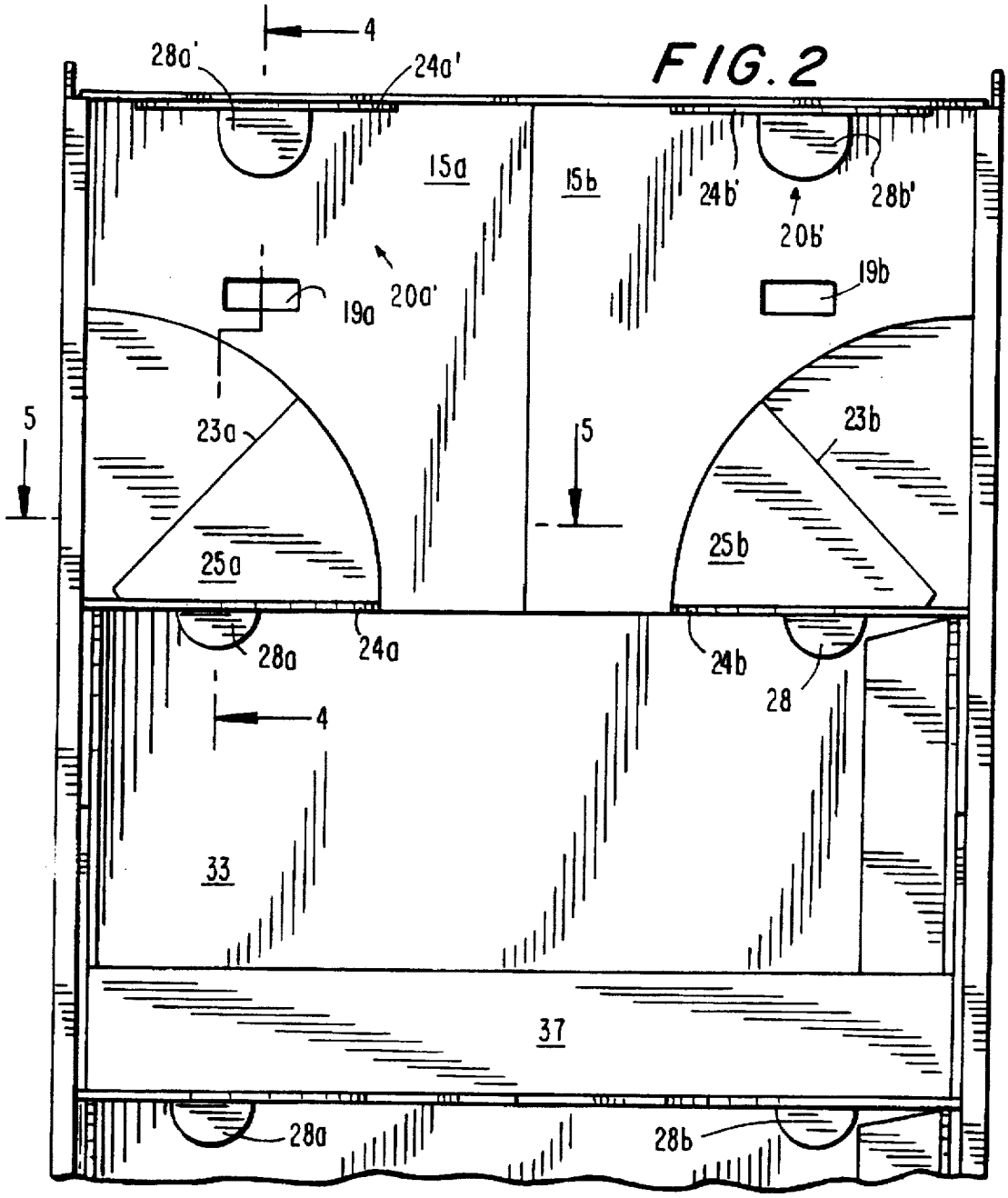
FIG. 2 is a front elevational view of a fragment of the support structure, taken in the directions of and substantially at the elevation of the arrows 2—2 appearing in FIG. 1.

Of course, FIG. 2 of the drawing also shows that the segments 24 indeed extend substantially horizontally, and that the segments 25 actually depend from the wall sections 15, being suspended from them by the respective hinge portions 23. It may also be perceived from FIG. 2 that the fingers 28 and 28' stand (as they must) in the way of straightforward introduction of the respective tray 30 into its assigned space in the support structure by just sliding it in along the upper surfaces of the support formation segments 24. As a matter of fact (going back to FIG. 1 of the drawing for a moment), it will be appreciated that the respective tray 30 will have to be tilted rearwardly during its introduction into the structure 10, so that the upper edge of its rear wall 33 will eventually pass underneath the fingers 28 or 28', whereupon the tilting action can be gradually discontinued with the rear wall 33 sliding in between the respective fingers 28 or 28' and the rear wall sections 15.

The weight of the trays 30 is quite negligible; however, the weight of the items contained in it more often than not is far from that. This substantial weight, resting on the respective support formations 20 and hence acting through them on the side walls 12/13, could cause the latter to bulge out, in some instances even to such an extent that the support of the affected tray(s) 30 on their support segments 20 would be compromised or terminated, with a resulting collapse of the whole or at least a part of the display arrangement. This, of course, would not bode well for the reputation of the establishment at which such a display arrangement had been installed and hence, by extension, that of the manufacturer of such an arrangement.

Figure 3:
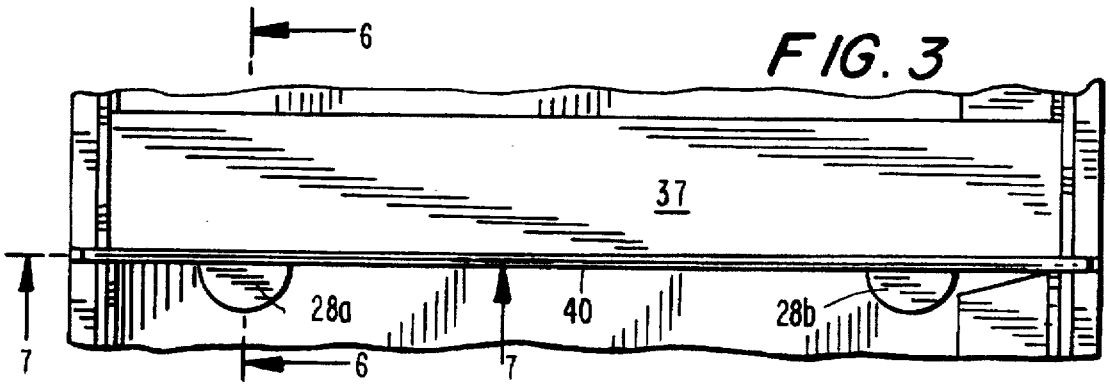
FIG. 3 is a view similar to that of FIG. 1 but of a different fragment of the support structure taken in the directions of and at the elevations indicated by the arrows 3—3 in FIG. 1.
Figure 6:
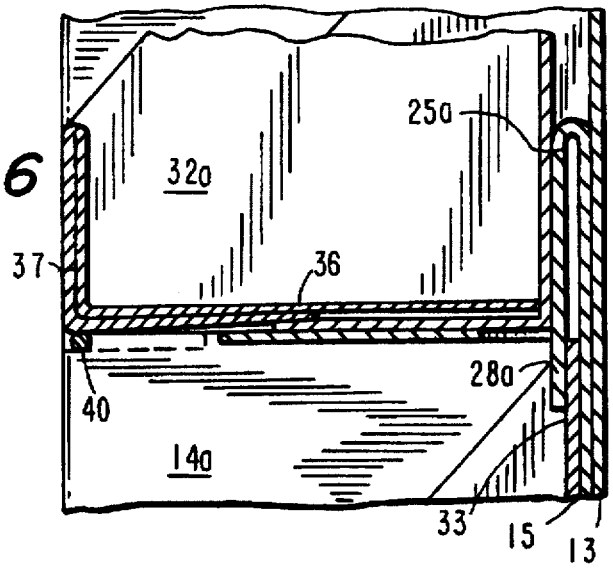
FIG. 6 is yet another sectional view of another fragment of the support structure but taken along line 6—6 of FIG. 3.
Figure 7:
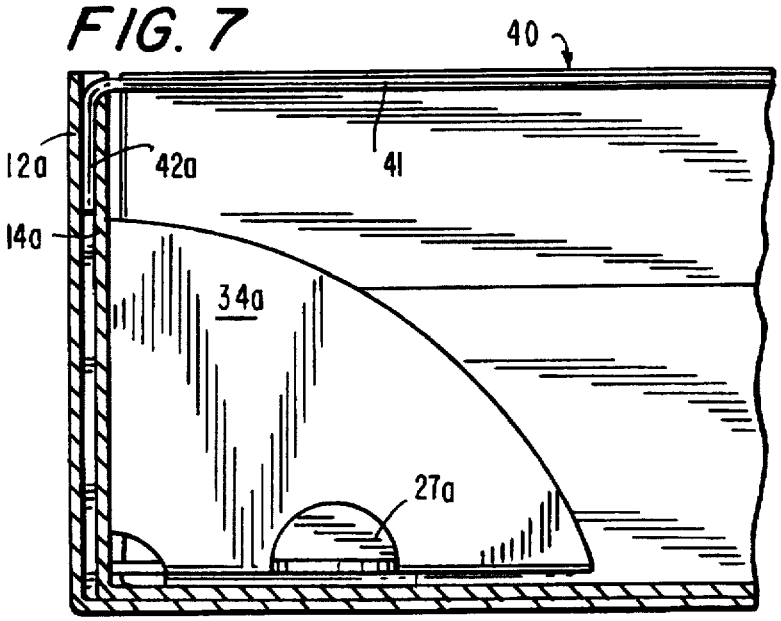
FIG. 7 is still another fragmentary sectional view, taken on line 7—7 in FIG. 3.

To avoid this possibility and especially its consequences, the support arrangement 10 is further provided, as shown particularly in FIGS. 3, 6 and 7, with at least one reinforcing element 40 that binds the side walls 12/13 with one another, i.e. prevents them from moving apart at its elevation. As seen particularly well in FIG. 7 of the drawing, the reinforcing element 40, which is preferably made of a metal wire or the like, but may even be made of a synthetic plastic or other material so long as that material exhibits sufficient sturdiness and tensile strength, has a main leg 41 which extends along the otherwise open front side of the support structure 10 and, at each of its ends, an auxiliary or anchoring leg 42 (*a* or *b*) that extends either into the space or interface present between the side walls 12 and 13, or into the corrugation flutes of one or the other of them, to anchor the reinforcing element at such locations and hence prevent the buckling of the side walls 12/13.

Figure 4:
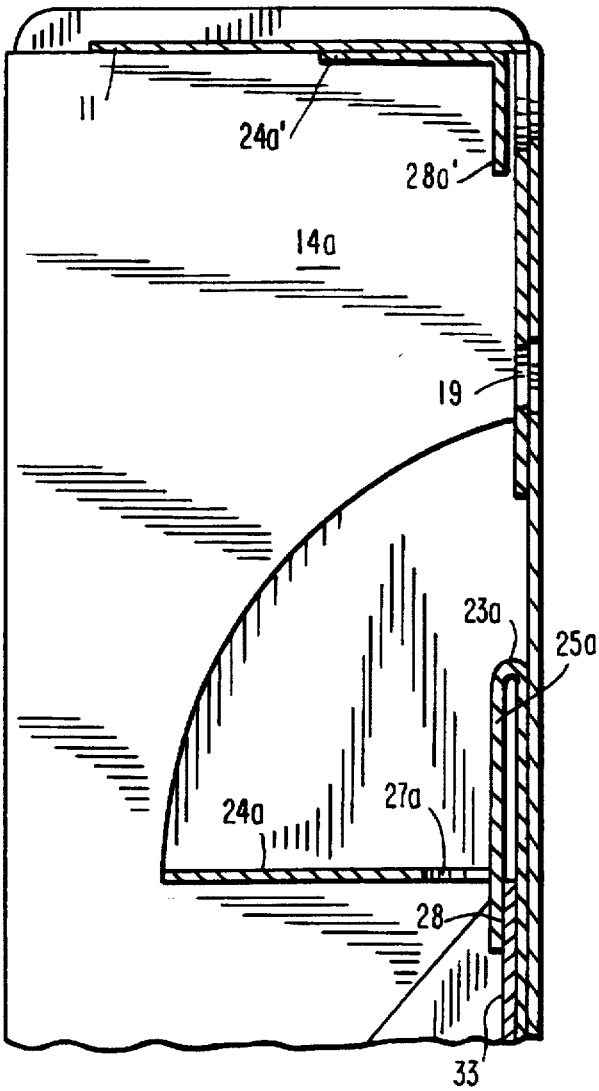
FIG. 4 is a fragmentary cross-sectional view of the support structure, taken on line 4—4 of FIG. 2.
Figure 5:
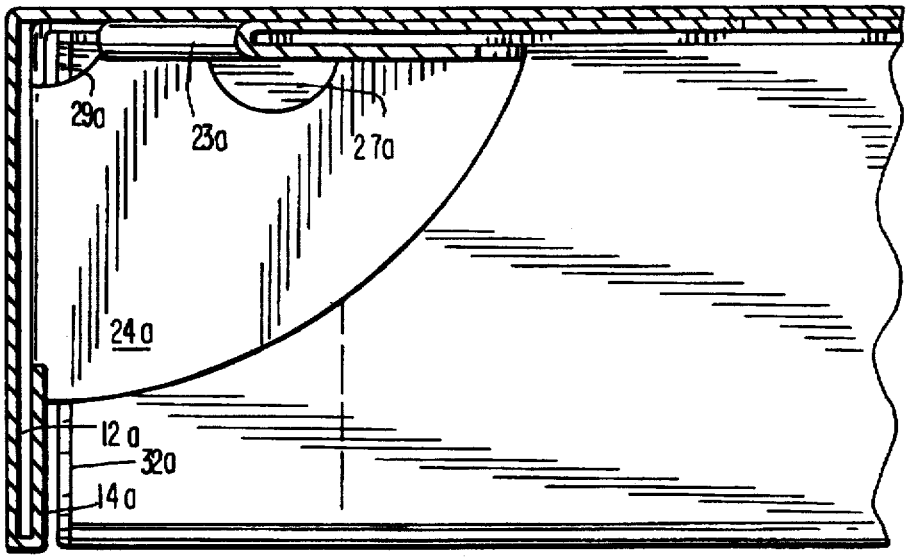
FIG. 5 is another fragmentary sectional view, this time taken on line 5—5 of FIG. 2.
Figure 8:
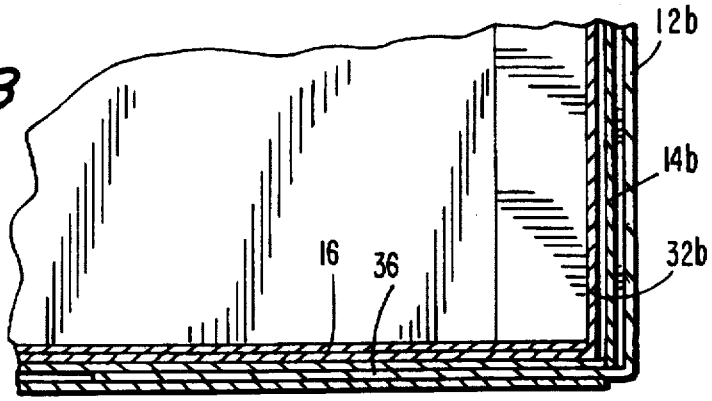
FIG. 8 is a view not unlike that of FIG. 7 but taken at the plane indicated by the arrows 8—8 of FIG. 1.

FIG. 4 of the drawing shows in more detail the aforementioned confinement of the rear wall 33 of the respective tray 30 behind the respective finger 28 (or 28', even though this is not shown), whereas FIG. 6, in addition to showing, consistently with other FIGS. of the drawing, the orientations of the segments 24 and 25, the presence of an orifice 29 at the juncture of the various hinge portions including the hinge portions 22 and 23. This orifice 29 serves, more than anything else, the purpose of preventing undue stress accumulation at the affected location during the folding of the segments 24 and 25 relative to one another and to their "maternal" side walls 14 and rear wall sections 15. Last but not least, FIG. 8 shows, among others, that the bottom walls of both the support structure 10 and of the respective tray 30 may be reinforced by the provision of not more particularly identified reinforcing walls at such locations.

FIG. 1, together with FIG. 4, also shows that the rear walls 13 and 15 may be provided with respective openings 19 (as shown, of rectangular configuration, but this particular shape is not all that critical). These openings are to be used either for the hanging of the support structure 10 on hooks or similar mounting elements jutting out of a wall or a similar support, or for the passage of precautionary fastening elements through them which may be used in conjunction with an otherwise free-standing display arrangement for assuring that the entire arrangement will not topple over.

It will be understood that each of the elements described above, or two or more together, may also find a useful application in other types of constructions differing from the type described above.

While the present invention has been described and illustrated herein as embodied in a specific construction of a support structure with replaceable display trays, it is not limited to the details of this particular construction, since various modifications and structural changes may be made without departing from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims:

1. A display arrangement comprising:

a) a support structure including a rear wall, a pair of side walls jutting out of the rear wall substantially perpendicularly thereto, and means for interconnecting said rear and side walls with one another in a manner maintaining them in their respective positions relative to one another so that they bound a confining space;

b) at least one pair of supporting formations integrally formed out of said side and rear walls and each including two segments one extending substantially perpendicularly to said rear wall and the other extending along one of said side and rear walls to hold said one segment in position; and c) at least one tray bounding a space for containing items to be displayed in the display arrangement and supported in said confining space of said support structure on said one segment of each of said supporting formations.

2. The display arrangement as defined in claim 1, wherein said tray includes at least a bottom wall, a rear wall having an upper region as considered in an inserted position in which said tray is received in said confining space, and two side walls secured to said bottom and rear walls and holding them in positions relative to one another; and wherein said support structure includes at least one finger arranged at but frontwardly spaced from said rear wall of said support structure and confining said upper region of said tray between itself and said rear wall of said support structure in said inserted position of said tray.

3. The display arrangement as defined in claim 2, wherein said finger is a portion of a holding element separate from said support structure but secured to it at its upper region.

4. The display arrangement as defined in claim 3, wherein said interconnecting means of said support structure includes at least a top wall connecting said rear and side walls with one another; and wherein said holding element is secured to said top wall.

5. The display arrangement as defined in claim 2, and further comprising at least one additional pair of supporting formations similar to said one pair of supporting formations but situated at a higher elevation than the latter on said support structure as considered in an erected state of the latter; and wherein each of said supporting formations of said additional pair carries said finger of its own for the confinement of that of said trays that is to be inserted into said confining space underneath said pair of supporting formations of said additional pair.

6. The display arrangement as defined in claim 1, wherein said interconnecting means includes at least one reinforcing element secured to said side walls of said support structure at a predetermined elevation of the latter as considered in an erected state of said support structure and operative for preventing said side walls from moving apart at said elevation.

7. The display arrangement as defined in claim 6, wherein said reinforcing element includes an elongated main portion extending across the space present between said side walls at an open front region of said support structure, and a pair of anchoring portions each rigidly connected with said main portion at a different end zone of the latter and extending along and anchored to a different one of said side walls of said support structure.

8. The display arrangement as defined in claim 1, wherein one of said segments of each of said support formations originally was an integral part of said side wall and the other a similarly integral part of said rear wall and are still connected to the them and to one another by respective hinge portions but separated from them by an incision for said segments to be able to move out of the planes of such side and rear walls and into their desired positions in said support structure during the erection of the latter.

9. The display arrangement as defined in claim 8, wherein said support structure includes main hinge portions each of which connect one of said side walls to said rear wall; and wherein that of said respective hinge portions which connects said one segment with said side wall extends substantially normal to the respective associated one of said main hinge portions whereas that of said respective hinge portions which connects said other segment with said rear wall includes an angle of substantially 45° with said associated main hinge portion.

10. The display arrangement as defined in claim 1, wherein said supporting formations are spaced apart in a transverse direction along said rear wall.

11. The display arrangement as defined in claim 1, wherein each segment of said supporting formations has a sector-like shape.

12. The display arrangement as defined in claim 1, wherein each respective incision is arcuate.

13. The display arrangement as defined in claim 1, wherein said support structure and said tray are each constituted of a corrugated board material.

14. The display arrangement as defined in claim 8, wherein said respective hinge portions of each said pair of support formations intersect at an aperture.

15. The display arrangement as defined in claim 1, wherein said rear wall of said support structure has means for mounting said support structure from a support above the ground.

16. The display arrangement as defined in claim 1, wherein said other segment of each said pair of supporting formations lies along said rear wall.

* * * * *